US008083442B2

(12) United States Patent
Pan

(10) Patent No.: US 8,083,442 B2
(45) Date of Patent: Dec. 27, 2011

(54) CUTTING TOOL FOR LAPPING PLATE

(75) Inventor: Yaoliang Pan, DongGuan (CN)

(73) Assignee: SAE Magnetics (H.K.) Ltd., Hong Kong (CN)

( * ) Notice: Subject to any disclaimer, the term of this patent is extended or adjusted under 35 U.S.C. 154(b) by 403 days.

(21) Appl. No.: 12/458,115

(22) Filed: Jun. 30, 2009

(65) Prior Publication Data

US 2010/0329799 A1 Dec. 30, 2010

(51) Int. Cl.
*B26D 1/25* (2006.01)
*B26D 1/00* (2006.01)

(52) U.S. Cl. ..... 407/54; 407/113

(58) Field of Classification Search ..... 407/53, 407/54, 65, 108, 110, 113, 114, 42
See application file for complete search history.

(56) References Cited

U.S. PATENT DOCUMENTS

| | | | | |
|---|---|---|---|---|
| 5,209,612 | A * | 5/1993 | Kish | 407/54 |
| 5,411,354 | A * | 5/1995 | Gustafsson | 407/110 |
| 5,439,327 | A * | 8/1995 | Wertheim | 407/11 |
| 5,707,185 | A * | 1/1998 | Mizutani | 407/42 |
| 5,975,812 | A * | 11/1999 | Friedman | 407/114 |
| 6,428,247 | B1 * | 8/2002 | Friedman | 407/110 |
| 6,960,049 | B2 * | 11/2005 | Inayama | 407/103 |
| 7,032,633 | B2 * | 4/2006 | Clay | 144/33 |
| 7,051,631 | B2 * | 5/2006 | Gati | 82/1.11 |
| 2010/0329799 | A1 * | 12/2010 | Pan | 407/53 |

* cited by examiner

*Primary Examiner* — Will Fridie, Jr.
(74) *Attorney, Agent, or Firm* — Nixon & Vanderhye PC

(57) ABSTRACT

A cutting tool for a lapping plate surface profile comprises a major body and a cutting body, and the cutting body comprises a first connection surface, a second connection surface and a third connection surface connecting the first connection surface and the second connection surface. The third connection surface has a secondary portion connecting a arc-shaped portion of the first connection portion and an inclined portion of the second connection portion. The cutting tool employs the arc-shaped portion and the secondary portion to cut the lapping plate so as to form a sound profile surface.

10 Claims, 8 Drawing Sheets

CUTTING TOOL FOR LAPPING PLATE

FIELD OF THE INVENTION

The present invention relates to a cutting tool, and more particularly, to a cutting tool for a lapping plate.

BACKGROUND OF THE INVENTION

Most computers use disk drives to store data. A disk drive typically includes one or more disks that the data is stored on, and a slider that are used to write data onto the disks and to read the data from the disks. Conventionally, the slider includes a substrate having an air bearing surface (ABS), a write head for writing data to the disk, a read sensor for reading data from the disk. The air bearing surface (ABS) of the slider provides the aerodynamic properties that enables the slider to "fly" over a disk. The read sensor has a height, which is commonly known as a stripe-height. In order for the slider as well as the read sensor and the write head to function properly, the ABS needs to be very flat and smooth and the read sensors need to have an appropriate stripe-height. Generally, traditional approach that has been effectively used by disk drive manufacturers to achieve the desired smoothness and the desired stripe-height is to employ a lapping plate for grinding and/or polishing the ABS (commonly referred to as the "lapping process") via a surface profile thereof. Therefore, the quality and characteristic of the surface profile of the lapping plate is critical in lapping the ABS of the slider. Thus disk drive manufacturers are constantly seeking ways to manufacturing a lapping pate of good quality in order to further produce excellent slider.

Till today, disk drive manufacturers have developed a cutting tool to forming the surface profile of the lapping plate. FIGS. 1 to 5 illustrate a conventional cutting tool 10 for the generation of a surface profile of a lapping plate. Referring to FIGS. 1-2, the cutting tool 10 comprises a major body 11 and a cutting body 12. The major body 11 has one end 111 defining a reference surface 111*a* and the other end 112 forming a cutout (not shown) at a free edge of the other end 112. The cutting body 12 is formed on the cutout of the other end 112 of the major body 11. The cutting body 12 has a first connection surface 121 connecting to one surface of the cutout and a second surface 122 connecting the first connection surface 121 with the other surface of the cutout. Referring to FIGS. 3-4, the first connection surface 121 has an arc-shaped portion 121*a* at a tip edge thereof. The radius R of the arc-shaped portion 121*a* is 1 cm and the radian A1 of the arc-shaped portion 121*a* is 90 degrees. Due to the surface of the lapping plate is usually curve, when the cutting tool 10 acts on the surface of the lapping plate to form a surface profile, the cutting tool 10 performs curvilinear motion along a radial direction D 1 (shown in FIG. 7) of the lapping plate. Generally, the radius R and the radian A1 of the first connection surface 121 of the cutting tool 10 are used to control the surface profile of lapping plate. Returning to FIGS. 1-2, the second connection surface 122 has an inclined portion 122*a* which is connected to the arc-shaped portion 121*a* of the first connection surface 121. In addition, the second connection portion further comprises two side portions 122*b*, 122*c* which respectively form beside the inclined portion 122*a* and respectively connect the inclined portion 122*a* from two sides with portions of the first connection surface 121 other than the arc-shaped portion 121*a*. Referring to FIG. 5, the arc-shaped portion 121*a* of the first connection portion 121 forms a first angle A2 with the reference surface 111*a*, the inclined portion 122*a* of the second connection surface 122 forms a second angle A3 with the reference surface 111*a*. The first angle A2 ranges from 6 degrees to 12 degrees and the second angle A3 ranges from 78 degrees to 84 degrees. The first angle A2 is designed for decreasing mechanical vibration in depth direction D2 of the lapping plate, and the second angle A3 is designed for decreasing mechanical vibration in radial direction D1 of the lapping plate.

FIG. 6 illustrates a conventional lapping plate 50. As shown in FIG. 6, the lapping plate 50 comprises a base plate 52 and a tin-bismuth plate 51 formed on the base plate 52. The tin-bismuth plate 51 is made of Sn (Stannum, tin) grains 511 occupying 98% and Bi (bismuth) grains 512 occupying 2%. As the tin-bismuth plate 51 consists of the Sn grains 511 and the Bi grains 512, thus arrangements and combinations of the Sn grains 511 and the Bi grains 512 produce grain boundaries 513 between the Sn grains 511 and the Bi grains 512. FIG. 7 illustrates the cutting body 12 of the cutting tool 10 of FIG. 1 forming surface profile of the lapping plate 50 of FIG. 6. Referring to FIG. 7, when the cutting body 12 of the cutting tool 10 performs curvilinear motion along a desired portion of the tin-bismuth plate 51 of the lapping plate 50 in the radial direction D1, the arc-shaped portion 121*a* of the first connection surface 121 of the cutting body 12 contacts the desired portion of the tin-bismuth plate 51 and cut the desired portion to form a surface profile. As the desired portion of the tin-bismuth plate 51 contact the cutting body 12 only via the arc-shaped portion 121*a*, the cutting step of the cutting body 12 makes the arc-shaped portion 121*a* produce forces on the tin-bismuth plate 51 in the same direction (as shown by arrow F). Resultant force of the forces in the same direction are so large that the Sn grains 511 or Bi grains 512 of the tin-bismuth plate 51 are easily peeled off, which causes to expand the size of grain boundaries 513. When the cutting body 12 continues to perform on the tin-bismuth plate 51 of the lapping plate 50, the size of grain boundaries 513 are likely to grow bigger and bigger to accordingly form Pin-holes in the surface profile of tin-bismuth plate 51, and thereby the lapping plate 50 with Pin-holes surface profile significantly affects the quality of sliders when lapping the sliders using the Pin-holes surface profile of the lapping plate 50.

Hence, it is desired to provide an improved cutting tool for the lapping plate to solve the above-mentioned problems and achieve a good performance.

SUMMARY OF THE INVENTION

Accordingly, an object of the present invention is to provide a cutting tool for a lapping plate, the cutting tool enabling to form sound surface profile of the lapping plate so as to manufacturing high-quality sliders.

In certain example embodiments of the invention, the cutting tool for a lapping plate comprises a major body and a cutting body. The major body has one end defining a reference surface and the other end forming a cutout at a free edge of the other end. The cutting body is formed on the cutout of the major body. The cutting body has a first connection surface connecting to one surface of the cutout and a second connection surface connecting the first connection surface with the other surface of the cutout. The first connection surface has an arc-shaped portion at a tip edge thereof which forms a first angle with the reference surface, and the second connection surface has an inclined portion which is connected to the arc-shaped portion and forms a second angle with the reference surface. The cutting body further comprises a third connection surface, the first connection surface connects to the second connection surface via the third connection surface, and the third connection surface has a secondary portion via which the arc-shaped portion connects to the inclined portion and the secondary portion forms a third angle with the reference surface.

Preferably, the first connection surface, the second connection surface and the third connection surface are integrally formed.

Preferably, the third angle ranges from 0 degree to 90 degrees.

Preferably, the third angle is 45 degrees.

Preferably, a width of the secondary portion ranges from 110 um to 150 um.

Preferably, the width is 130 um.

Preferably, the cutting body is made of diamond and the main body is made of stainless steel.

Preferably, the radius of the arc-shaped portion is 1 cm and the radian of the arc-shaped portion is 90 degrees.

Preferably, the first angle ranges from 6 degrees to 12 degrees.

Preferably, the second angle ranges from 78 degrees to 84 degrees.

Compared with the conventional cutting tool, the cutting tool for the lapping plate according to the present invention has a cutting body with a first connection surface, a second connection surface and a third connection surface. When the cutting tool performs curvilinear motion along a desired portion of the tin-bismuth plate of a conventional lapping plate in the radial direction, the arc-shaped portion of the first connection surface and the secondary portion of the third connection surface of the cutting body contacts the desired portion of the tin-bismuth plate. As the desired portion of the tin-bismuth plate contact the cutting body via two portions such as the arc-shaped portion and the secondary portion, the cutting step of the cutting body makes the arc-shaped portion and the secondary portion together produce forces on the tin-bismuth plate in different direction. Resultant force of the forces in different direction is low, which according causes Sn grains or Bi grains of the tin-bismuth plate difficult to peel off, and in turn, the size of grain boundaries will not expand and thus less Pin-holes will be formed in the surface profile of tin-bismuth plate, thereby further improve quality of sliders when lapping the sliders using the less Pin-holes surface profile of the lapping plate.

Other aspects, features, and advantages of this invention will become apparent from the following detailed description when taken in conjunction with the accompanying drawings, which are a part of this disclosure and which illustrate by way of example, principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
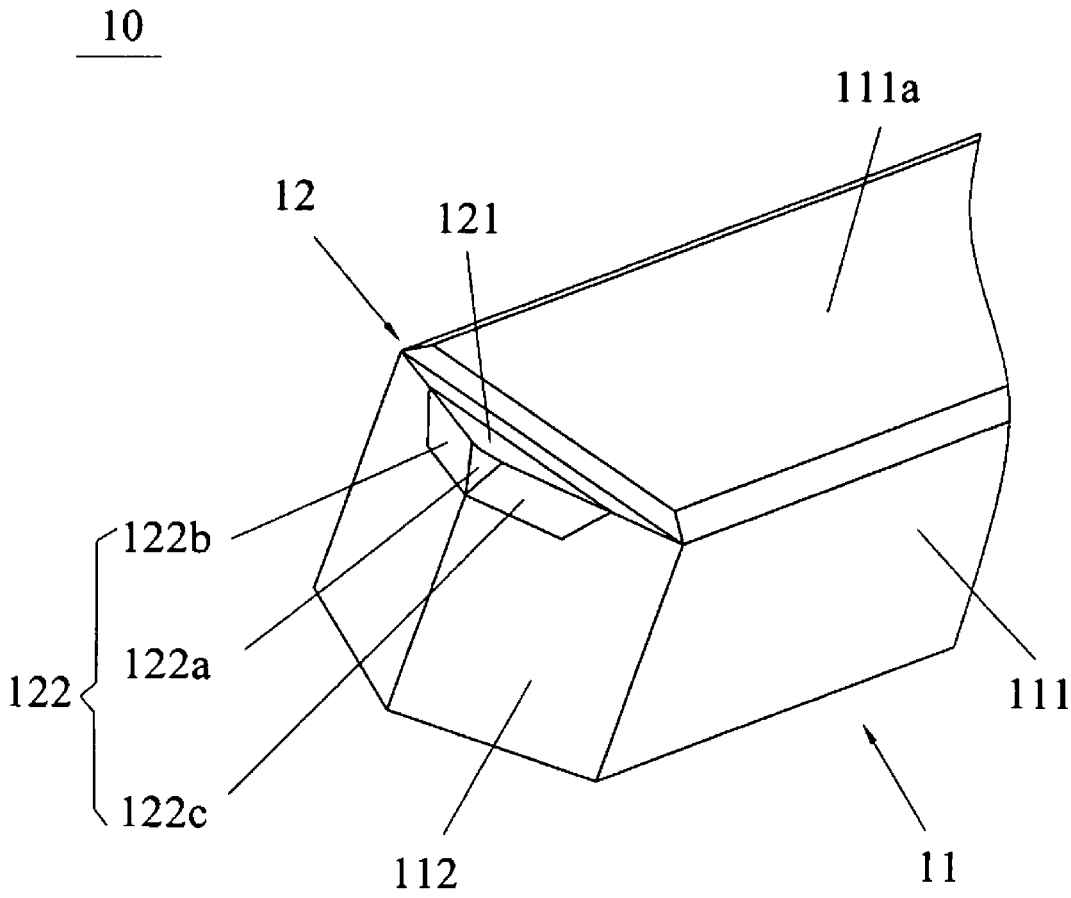
FIG.1 (PRIOR ART)
FIG. 1 is a perspective view of a conventional cutting tool for a lapping plate.
Figure 2:
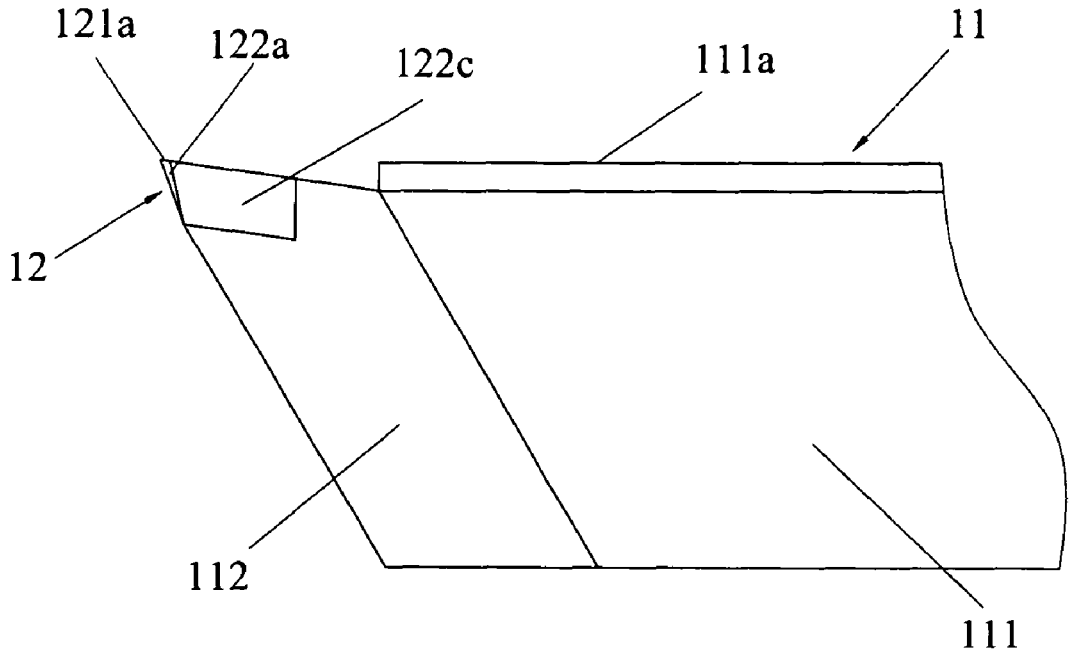
FIG.2 (PRIOR ART)
FIG. 2 is a sectional view of the cutting tool shown in FIG. 1.
Figure 3:
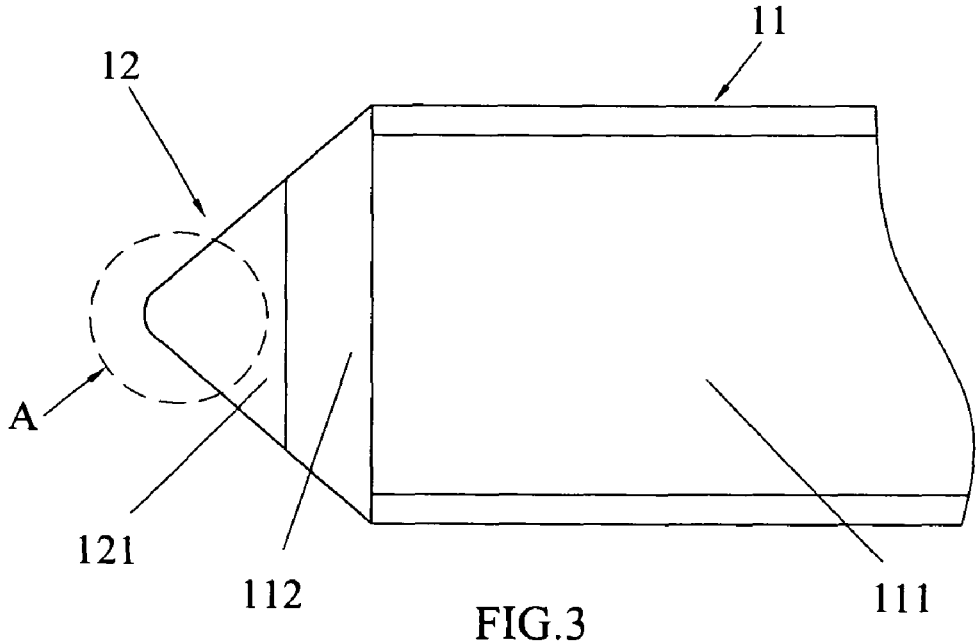
FIG.3 (PRIOR ART)
FIG. 3 is a top plan view of the cutting tool shown in FIG. 1.
Figure 4:
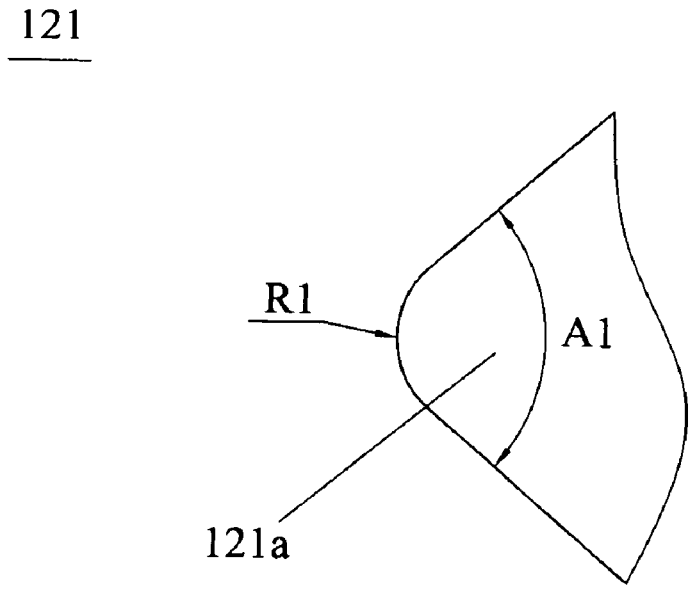
FIG.4 (PRIOR ART)
FIG. 4 is a partial enlarged view of a first connection surface of a cutting body of the cutting tool shown in FIG. 3, specifically illustrating a arc-shaped portion of the first connection surface indicated by arrow A.
Figure 5:
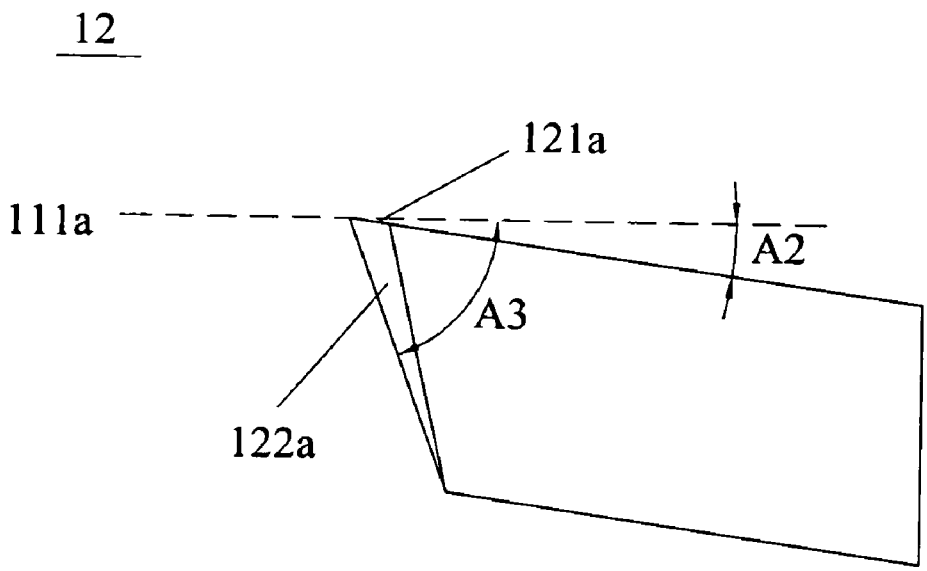
FIG.5 (PRIOR ART)
FIG. 5 is a sectional enlarged view of a cutting body of the cutting tool shown in FIG. 1.

Various preferred embodiments of the invention will now be described with reference to the figures, wherein like reference numerals designate similar parts throughout the various views. As indicated above, the invention is directed to a cutting tool for a lapping plate, and the cutting tool enables to form sound surface profile of the lapping plate so as to manufacturing high-quality sliders.

Figure 8:
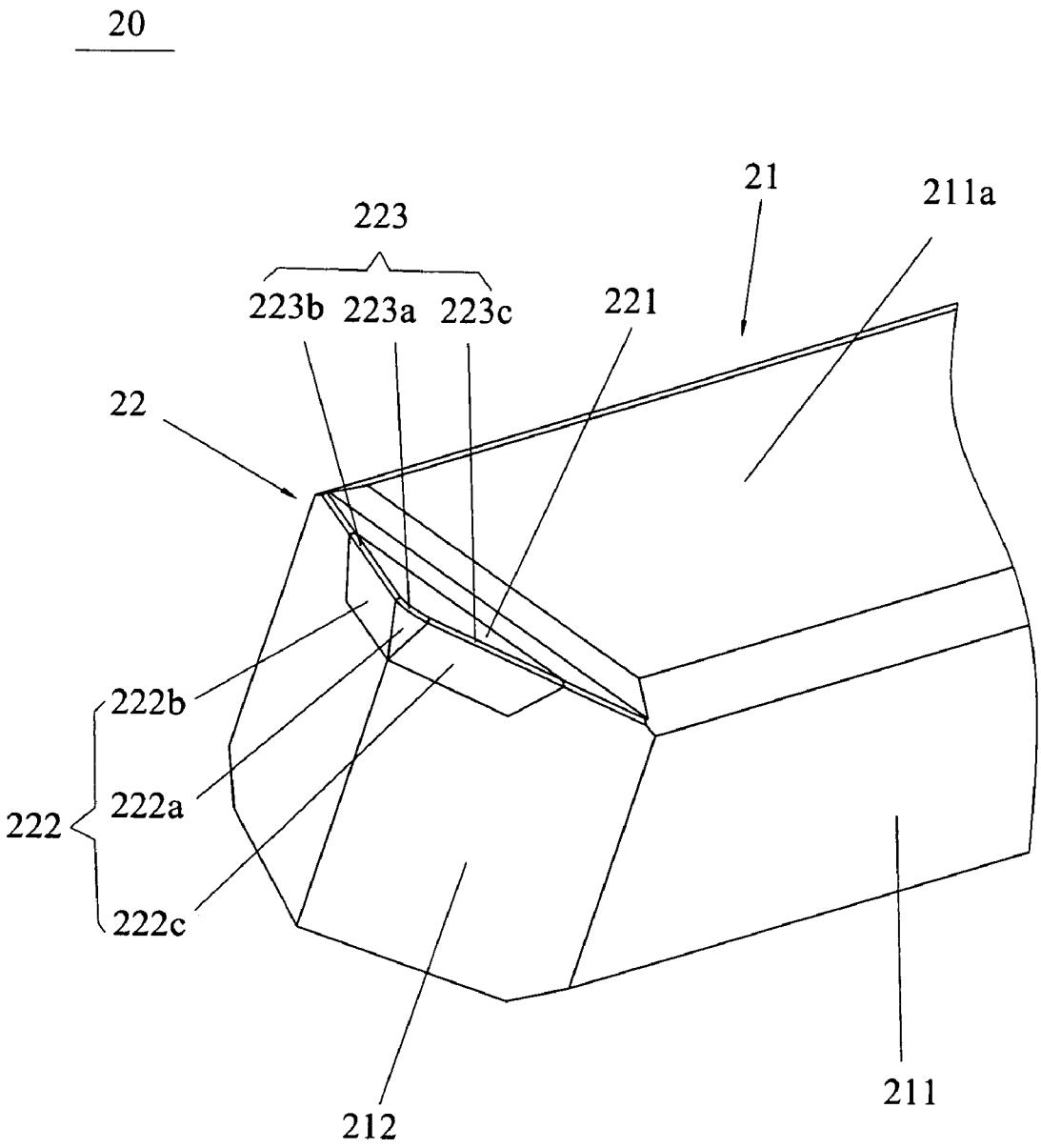
FIG. 8 is a perspective view of a cutting tool for a lapping plate according to the present invention.
Figure 9:
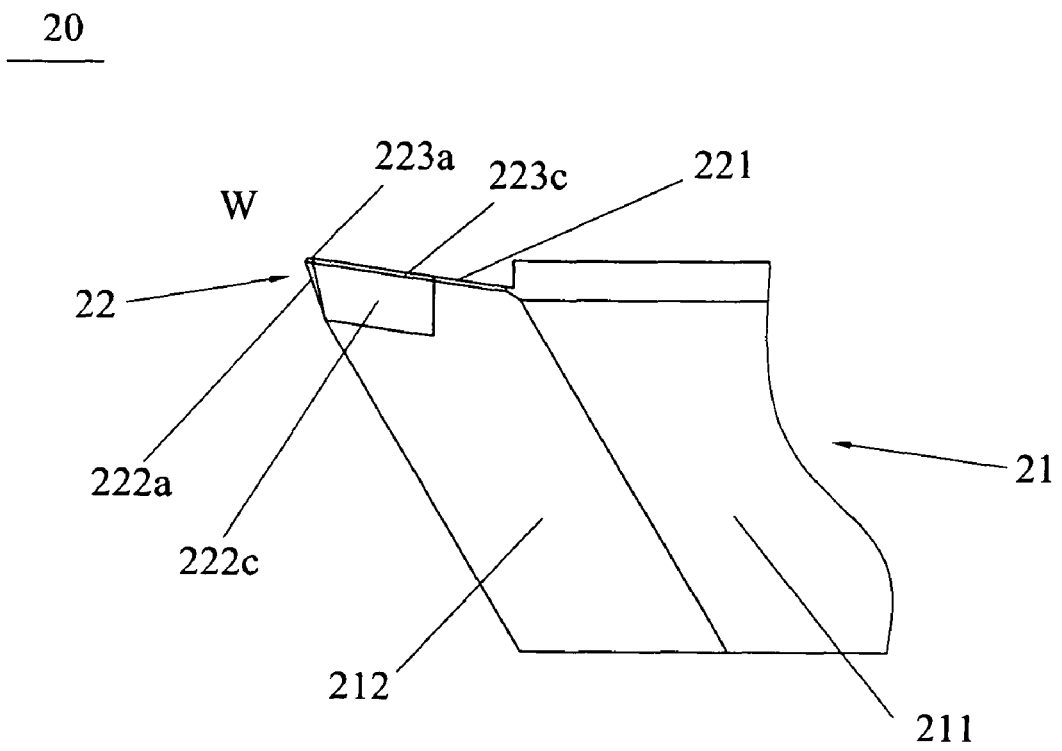
FIG. 9 is a sectional view of the cutting tool shown in FIG. 8.
Figure 10:
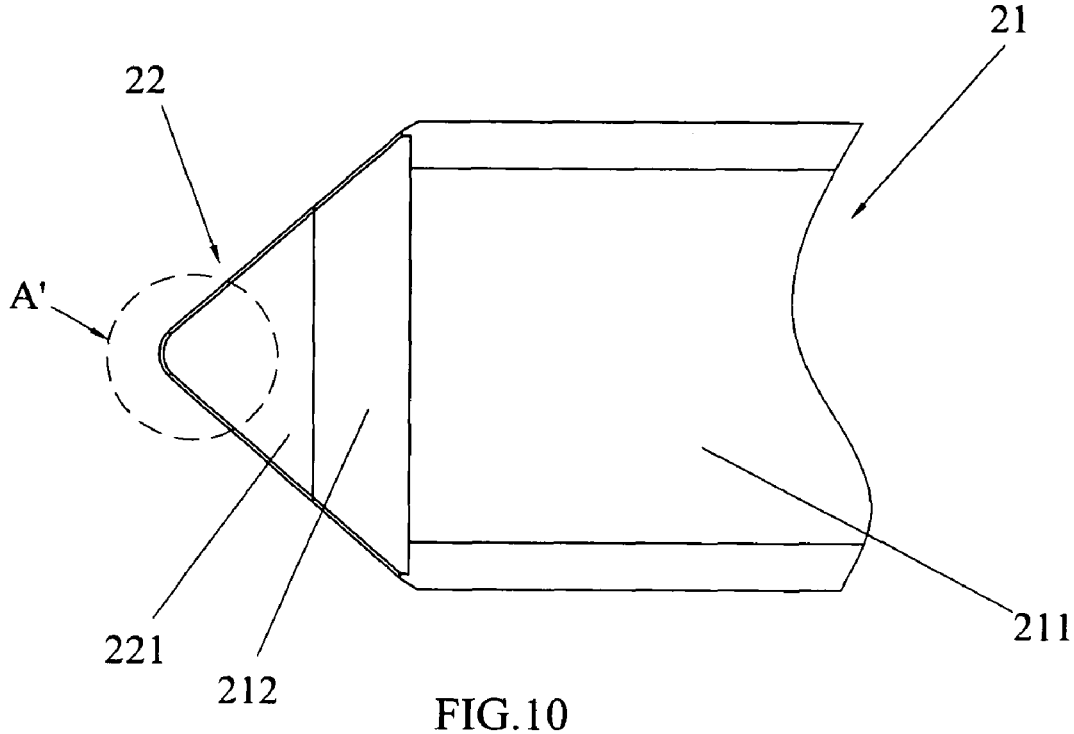
FIG. 10 is a top plan view of the cutting tool shown in FIG. 8.
Figure 11:
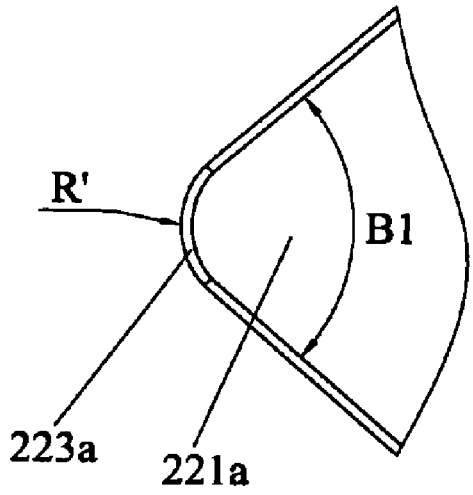
FIG. 11 is a partial enlarged view of a first connection surface of a cutting body of the cutting tool shown in FIG. 10, specifically illustrating a arc-shaped portion of the first connection surface indicated by arrow A'.

FIGS. 8-13 illustrate an embodiment of a cutting tool for a lapping plate according to the present invention. Referring to FIGS. 8-9, the cutting tool 20 comprises a major body 21 and a cutting body 22. Preferably, the cutting body 22 is made of diamond and the major body 21 is made of stainless steel. The major body 21 has one end 211 defining a reference surface 211*a* and the other end 212 forming a cutout (not shown) at a free edge of the other end 212. The cutting body 12 is formed on the cutout of the other end 212 of the major body 21. The cutting body 22 has a first connection surface 221 connecting to one surface of the cutout, a second surface 222 connecting to the other surface of the cutout, and a third connection surface 223 connecting the first connection surface 221 with the second connection surface 222. Preferably, the first connection surface 221, the second connection surface 222 and the third connection surface 223 are integrally formed. Referring to FIGS. 10-11, the first connection surface 221 has an arc-shaped portion 221*a* at a tip edge thereof. The radius R' of the arc-shaped portion 221*a* is preferably 1 cm and the radian B1 of the arc-shaped portion 221*a* is preferably 90 degrees. The radius R' and the radian B1 of the arc-shaped portion 221*a* of the first connection surface 221 are used to control the surface profile of lapping plate.

Figure 12:
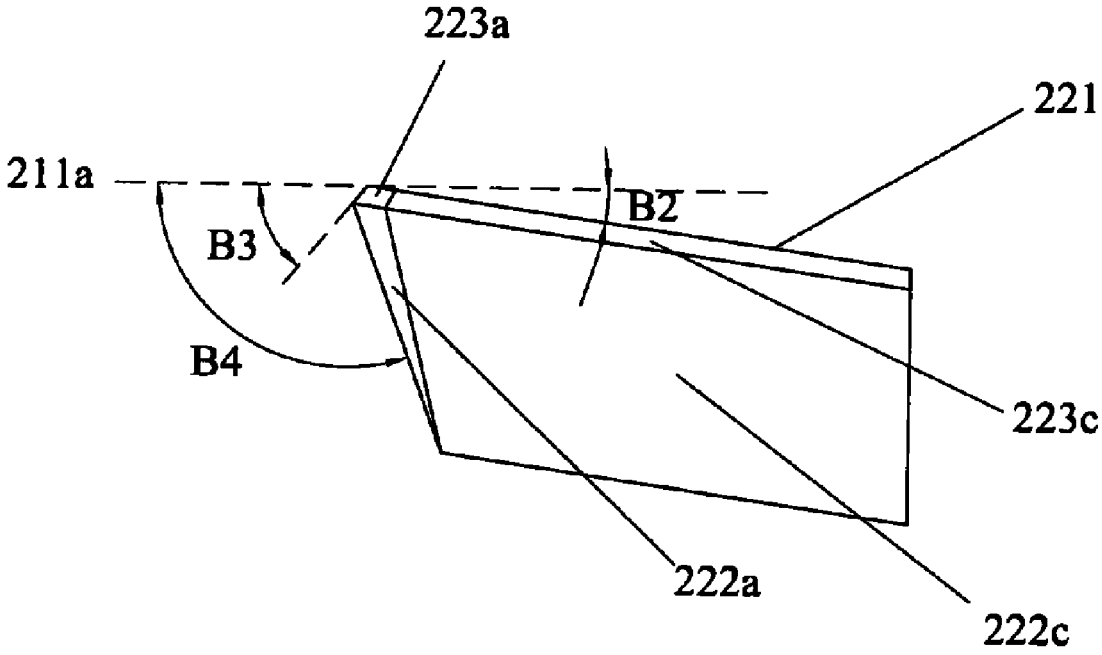
FIG. 12 is a sectional enlarged view of a cutting body of the cutting tool shown in FIG. 8.

Returning to FIG. 8-9, the third connection surface 223 has a secondary portion 223*a* which connects the arc-shaped portion 221*a* of the first connection surface 221. In addition, the third connection surface 223 further comprises two side portions 223*b*, 223*c* which respectively form beside the secondary portion 223*a* and respectively connect the secondary portion 223*a* from two sides with portions of the first connection surface 221 other than the arc-shaped portion 221*a*. The second connection surface 222 has an inclined portion 222*a* which is connected to the secondary portion 223*a* of the third connection surface 223. In addition, the second connection portion further comprises two side portions 222*b*, 222*c* which respectively form beside the inclined portion 222*a* and respectively connect the inclined portion 222*a* from two sides with the two side portions 223*a*, 223*b* of the third connection surface 223. Referring to FIG. 12, the arc-shaped portion 221*a* of the first connection surface 221 forms a first angle B2 with the reference surface 211*a*, the secondary portion 223*a* of the third connection portion 223 forms a third angle B 4 with the reference surface 211*a*, the inclined portion 222*a* of the second connection portion 222 forms a second angle B3 with the reference surface 211*a*. The first angle B2 ranges from 6 degrees to 12 degrees and is preferably 8 degrees. The second angle B3 ranges from 78 degrees to 84 degrees and is preferably 82 degrees. The first angle B2 is designed for decreasing the mechanical vibration in depth direction D2 (shown in FIG. 13) of the lapping plate, and the second angle B3 is designed for decreasing the mechanical vibration in radial direction D1 (shown in FIG. 13) of the lapping plate. The third angle B4 ranges from 0 degree to 90 degrees and is preferably 45 degrees. Returning to FIG. 9, a width W of the secondary portion 223*a* ranges from 110 um to 150 um and is preferably 130 um.

Figure 6:
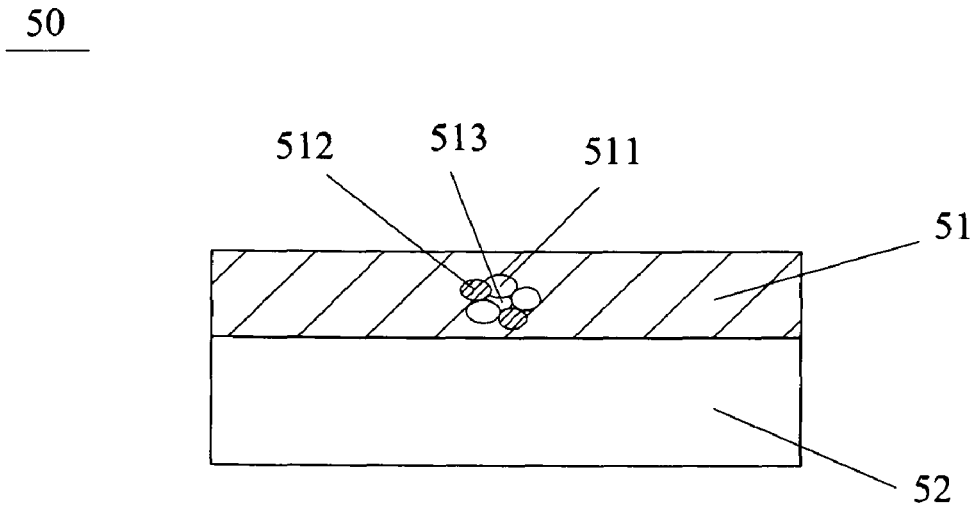
FIG.6 (PRIOR ART)
FIG. 6 is a sectional view of a conventional lapping plate.
Figure 7:
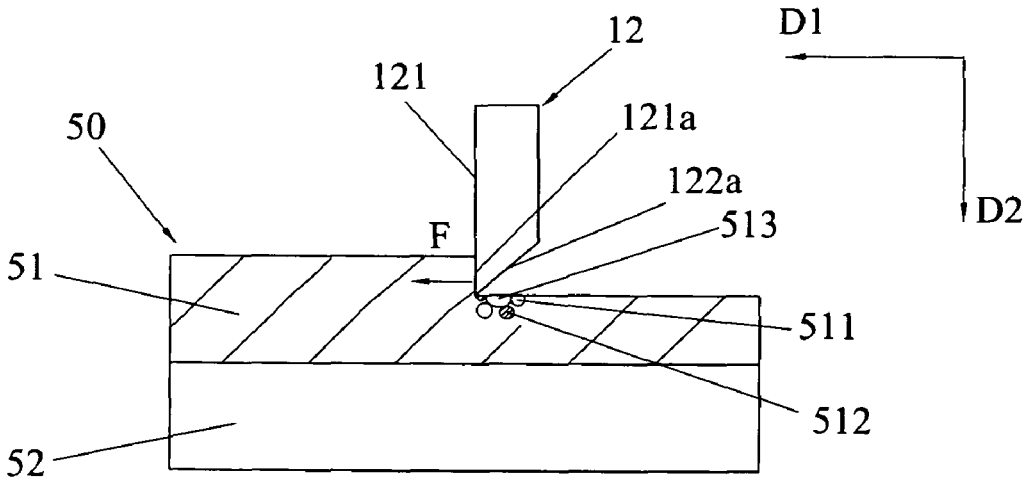
FIG.7 (PRIOR ART)
FIG. 7 is a view illustrating the cutting body of FIG. 5 cutting the lapping plate of FIG. 6 to form a surface profile.
Figure 13:
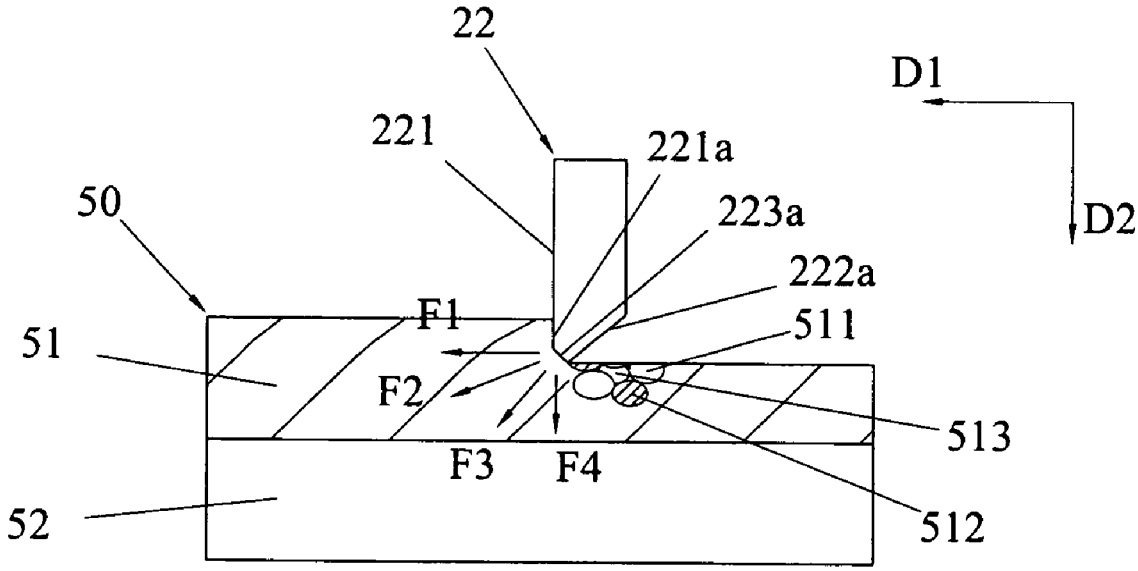
FIG. 13 is a view illustrating the cutting body of FIG. 12 cutting the lapping plate of FIG. 6 to form a surface profile.

FIG. 13 is a view illustrating the cutting body of FIG. 12 cutting the lapping plate of FIG. 6 to form a surface profile. Referring to FIG. 13, when the cutting tool 20 performs curvilinear motion along a desired portion of a tin-bismuth plate 51 of a conventional lapping plate 50 in the radial direction D1, the arc-shaped portion 221*a* of the first connection surface 221 and the secondary portion 223*a* of the third connection surface 223 of the cutting body 22 contacts the desired portion of the tin-bismuth plate 51. As the desired portion of the tin-bismuth plate 51 contact the cutting body 22 via two portions such as the arc-shaped portion 221*a* and the secondary portion 223*a*, the cutting step of the cutting body 22 makes the arc-shaped portion 221*a* and the secondary portion 223*a* together produce forces F1, F2, F3 and F4 on the tin-bismuth plate 51 in different direction. Resultant force of the forces F1, F2, F3 and F4 in different direction is low, which causes Sn grains or Bi grains of the tin-bismuth plate 51 difficult to peel off, and in turn, the size of grain boundaries 513 will not expand and thus less Pin-holes will be formed in the surface profile of tin-bismuth plate 51, thereby further improve quality of sliders when lapping the sliders using the less Pin-holes surface profile of the lapping plate 50.

The foregoing description of the present invention has been presented for purposes of illustration and description. It is not intended to be exhaustive or limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A cutting tool for a lapping plate, comprising:

a major body, one end of the major body defining a reference surface and the other end of the major body forming a cutout at a free edge thereof; and a cutting body formed on the cutout of the major body, the cutting body having a first connection surface connecting to one surface of the cutout and a second connection surface connecting the first connection surface with the other surface of the cutout, the first connection surface having an arc-shaped portion at a tip edge thereof which forms a first angle with the reference surface, the second connection surface having an inclined portion which is connected to the arc-shaped portion and forms a second angle with the reference surface, wherein the cutting body further comprises a third connection surface, the first connection surface connects to the second connection surface via the third connection surface, and the third connection surface has a secondary portion via which the arc-shaped portion connects to the inclined portion and the secondary portion forms a third angle with the reference surface.

2. The cutting tool according to claim 1, wherein the first connection surface, the second connection surface and the third connection surface are integrally formed.

3. The cutting tool according to claim 1, wherein the third angle ranges from 0 degree to 90 degrees.

4. The cutting tool according to claim 3, wherein the third angle is 45 degrees.

5. The cutting tool according to claim 1, wherein a width of the secondary portion ranges from 110 um to 150 um.

6. The cutting tool according to claim 5, wherein the width is 130 um.

7. The cutting tool according to claim 1, wherein the cutting body is made of diamond and the main body is made of stainless steel.

8. The cutting tool according to claim 1, wherein the radius of the arc-shaped portion is 1 cm and the radian of the arc-shaped portion is 90 degrees.

9. The cutting tool according to claim 1, wherein the first angle ranges from 6 degrees to 12 degrees.

10. The cutting tool according to claim 1, wherein the second angle ranges from 78 degrees to 84 degrees.

* * * * *